US005541612A

United States Patent [19]

Josefsson

[11] Patent Number: 5,541,612

[45] Date of Patent: Jul. 30, 1996

[54] WAVEGUIDE ANTENNA WHICH INCLUDES A SLOTTED HOLLOW WAVEGUIDE

[75] Inventor: Lars G. Josefsson, Askim, Sweden

[73] Assignee: Telefonaktiebolaget LM Ericsson, Stockholm, Sweden

[21] Appl. No.: 307,101

[22] Filed: Sep. 16, 1994

Related U.S. Application Data

[63] Continuation of Ser. No. 980,731, Nov. 24, 1992, abandoned.

[30] Foreign Application Priority Data

Nov. 29, 1991 [SE] Sweden ..... 9103555

[51] Int. Cl.[6] ..... H01Q 13/10

[52] U.S. Cl. ..... 343/771; 343/770; 333/237

[58] Field of Search ..... 343/771, 768, 343/770; 333/113, 248, 237; H01Q 13/10, 13/20, 13/22

[56] References Cited

U.S. PATENT DOCUMENTS

| | | | |
|---|---|---|---|
| 2,349,942 | 5/1944 | Dällenbach | 343/771 X |
| 2,632,809 | 3/1953 | Riblet | 333/113 |
| 2,659,005 | 11/1953 | Gruenberg | 343/771 X |
| 2,982,960 | 5/1961 | Shanks | 343/767 |
| 3,328,800 | 6/1967 | Algeo | 343/771 X |
| 3,348,227 | 10/1967 | Rolfs | 343/768 |
| 3,523,297 | 8/1970 | Fee | 343/771 X |
| 3,570,007 | 4/1968 | Whitehead | 343/771 |
| 3,594,806 | 7/1971 | Black | 343/771 |
| 3,599,215 | 8/1971 | Yoshida et al. | 343/767 |
| 3,599,216 | 8/1971 | Paine et al. | 343/771 |
| 3,691,563 | 9/1972 | Shelton | 343/771 |
| 3,860,933 | 1/1975 | Terakawa et al. | 343/771 |
| 4,164,742 | 8/1979 | Nemit | 343/771 X |
| 4,429,313 | 1/1984 | Muhs, Jr. et al. | 343/771 |
| 4,499,474 | 2/1985 | Muhs, Jr. et al. | 343/771 |
| 4,985,708 | 1/1991 | Kelly | 343/770 X |
| 5,172,127 | 12/1992 | Josefsson | 343/771 |
| 5,173,714 | 12/1992 | Arimura et al. | 343/770 X |

FOREIGN PATENT DOCUMENTS

| | | | |
|---|---|---|---|
| 2390027 | 12/1978 | France | H01Q 13/10 |
| 0669463 | 4/1952 | United Kingdom | 333/113 |
| 1573604 | 8/1980 | United Kingdom . | |

OTHER PUBLICATIONS

A. J. Sangster, entitled "Polarisation Diversity Techniques for Slotted–Waveguide Array Antennas", and appearing in *Mikrowellen & HF Magazin,* vol. 15, No. 3, 1989, pp. 237–243.

*Primary Examiner*—Donald T. Hajec
*Assistant Examiner*—Steven Wigmore
*Attorney, Agent, or Firm*—Burns, Doane, Swecker & Mathis L.L.P.

[57] ABSTRACT

A waveguide antenna (1) has an upper (2) and air (3) cavity waveguide, these waveguides being separated by a partition wall (4). Transversely extending slots (7) are disposed along the center line of the upper waveguide (2) with a mutual spacing of one wavelength-distance ($\lambda_g$). Two slots (6) which extend in the direction of the longitudinal axis of the waveguide are disposed between the transversal slots (7). The partition wall (4) is provided with longitudinally extending slots (8) immediately beneath the longitudinally extending slots (6), and field-shifting posts (9) are placed in the lower waveguide (3) adjacent the latter slots (8) in a zig-zag pattern along the waveguide (3). Baffles (10) counteract grating lobes. A fundamental mode of an electromagnetic field (E1) in the upper waveguide (2) excites only the transversal slots (7), which radiate a field (E3). The same fundamental mode (E2) in the lower waveguide (3) excites the slots (8) in the partition wall. These latter slots radiate a field (E4) which excites only the upper longitudinally extending slots (6), which radiate a field (E5). Supply of the fundamental modes (E1, E2) and also the radiated fields (E3, E5) are independent of one another and a desired polarization can be obtained. A radiated lobe is symmetric and the radiated fields (E3, E5) can carry individual information.

31 Claims, 5 Drawing Sheets

WAVEGUIDE ANTENNA WHICH INCLUDES A SLOTTED HOLLOW WAVEGUIDE

This application is a continuation of application of Ser. No. 07/980,731, filed Nov. 24, 1992, now abandoned.

TECHNICAL FIELD

The present invention relates to a waveguide antenna which includes at least one elongated cavity waveguide that is provided with slots which extend in the direction of the longitudinal axis of the waveguide and transversely to said axis and through which the waveguide transmits electromagnetic fields which have different directions of polarization.

BACKGROUND ART

It is well known in the transmission of radar waves for instance, to use cavity waveguides which are provided with slots from which the electromagnetic field radiates. It is desirable in this regard to be able to choose the polarization of the radiated field. U.S. Pat. No. 2,982,960 teaches an antenna having hollow waveguides which are capable of emitting such a field of desired polarization. The antenna has a waveguide which is fed by two mutually perpendicular inputs on the sides of the waveguide. Two orthogonal fields are excited in the waveguide via the inputs. The waveguide is provided on one side thereof with mutually intersecting and transversely and longitudinally extending slots, each of which radiates a respective one of the aforesaid two orthogonal fields. However, the antenna has the drawback of producing higher-order radiation loads, so-called grating lobes, if the slots are located at a resonant distance from one another. When there is no resonant distance between the slots, there is obtained an antenna lobe which radiates laterally from the geometric normal of the antenna and the direction of which is frequency-dependent.

U.S. Pat. No. 3,348,227 teaches an antenna having a cavity waveguide which is provided on its broadest side with mutually separated and transversely and longitudinally extending slots. Energy is delivered to the antenna in an oscillating mode and the antenna radiates a field whose direction of polarization can be chosen in accordance with the way in which the energy is delivered. Energy is delivered to the slots through the common waveguide and only one polarization direction can be chosen at any one moment in time. Consequently, only one information-carrying signal can be transmitted.

An overall view of individual antennas provided with slotted waveguides and providing selective polarization is given in an article in MIKROWELLEN & HF MAGAZIN, Vol. 15, No. 3, 1989, by A. J. Sangster: "Polarisation Diversity Techniques for Slotted-Wave-guide Antennas". Of the antennas illustrated, the antenna which is most relevant in the present case is the antenna shown in FIG. 9 of the article, which illustrates a waveguide having longitudinal and transversal slots. The waveguide is intended for higher-order propagation modes of an electromagnetic wave and one drawback with this particular waveguide resides in its large width. Waves emanating from several mutually adjacent waveguides are able to generate an antenna lobe which can be directed laterally by phase-shifting the waves supplied to the different waveguides. However, this results in grating lobes in the lateral direction. Grating lobes also occur in the longitudinal direction, since the slots are placed apart at a resonant distance along the waveguide. When the slots are placed closer together, the grating lobes are avoided in this latter direction, although the radiation lobe is directed obliquely, the direction of said lobe being frequency-dependent.

SUMMARY OF THE INVENTION

The object of the present invention is to eliminate the drawbacks of the older slotted-waveguide antennas. According to the present invention, the waveguide antenna includes a pair of waveguides having two superposed single-mode hollow waveguides which are mutually separated by a partition wall. Electromagnetic waves having two mutually perpendicular polarizations are emitted through separate antenna ports, which are comprised of two separate arrays of slots in the upper wall of the upper waveguide.

The separate antenna ports can be excited either simultaneously or individually. Selected polarization of one transmitted electromagnetic field can be obtained by varying the amplitude and phase of the signals to respective antenna ports. The slots of one antenna port are excited by an electromagnetic field which is delivered to the upper waveguide. The slots in the other antenna port are excited by an electromagnetic field which is delivered from slots in the partition wall between the two waveguides. In turn, these slots are excited by an electromagnetic field delivered to the lower waveguide. The field emanating from the slots in the partition wall is orthogonal to the field in the upper waveguide and the two fields do not influence one another in the waveguide. The field emanating from the lower slots does not influence the upper waveguide, but passes unaffected therethrough and excites its antenna port in the upper wall of the upper waveguide. The desired polarization is obtained by delivering energy to the two waveguides independently of one another.

The invention is characterized by the features set forth in the following Claims.

BRIEF DESCRIPTION OF THE DRAWINGS

The invention will now be described in more detail with reference to exemplifying embodiments thereof and also with reference to the accompanying drawings, in which.

BEST MODE OF CARRYING OUT THE INVENTION

Figure 1:
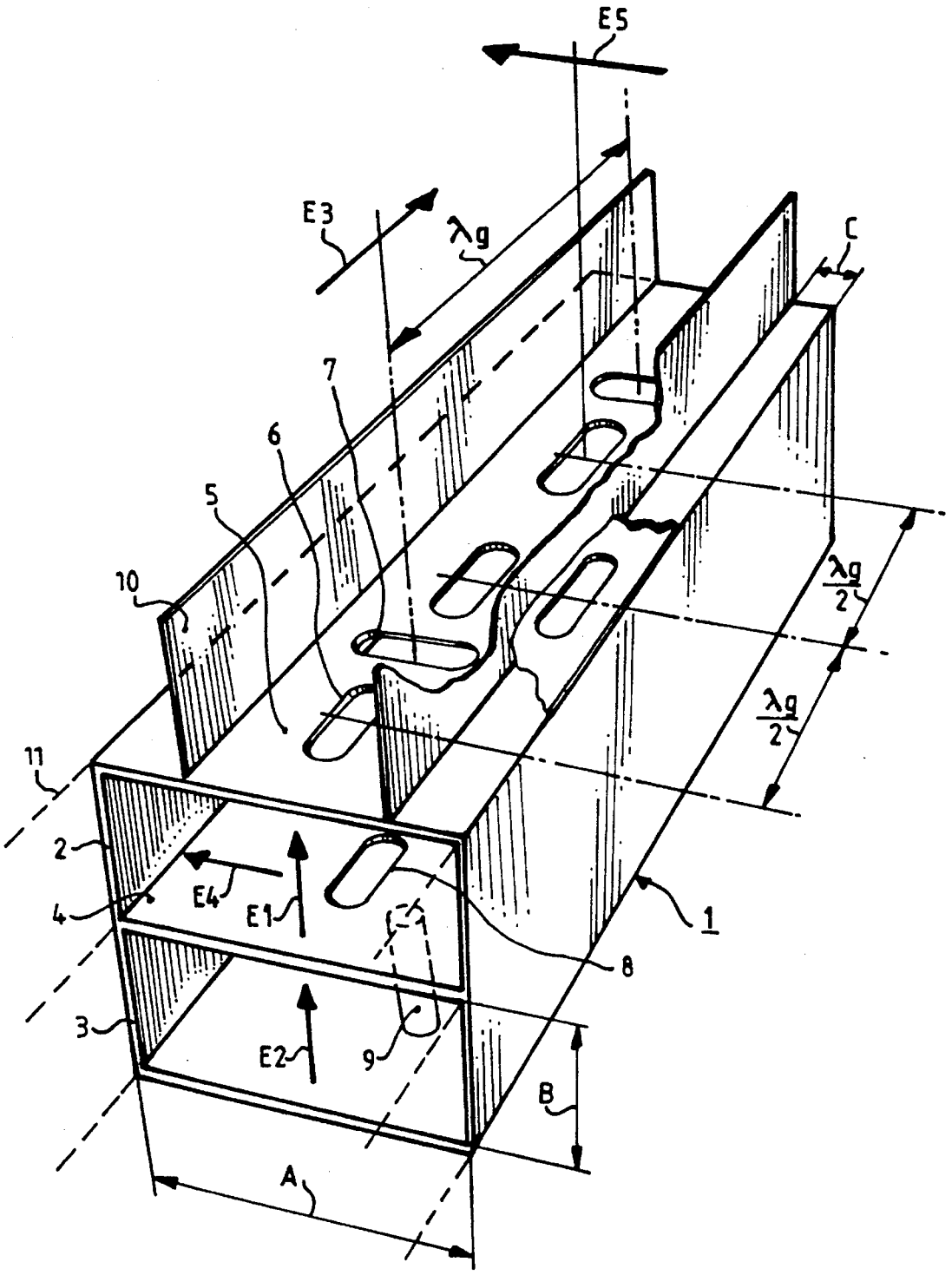
FIG. 1 is a perspective view of one piece of a waveguide pair.

FIG. 1 illustrates an inventive waveguide antenna 1. The illustrated antenna includes an upper rectangular cavity waveguide 2 and a lower rectangular cavity waveguide 3 which are made of an electrically conductive material. The waveguides are elongated and placed one on top of the other with their broad sides facing towards one another, and are mutually separated by a partition wall 4. Provided in the upper wall of the upper waveguide 2 are longitudinally extending slots 6 which together form one antenna port of said antenna, and also with transversely extending slots 7 which together form another antenna port of said antenna. The slots are positioned generally along a centre line of the upper wall 5. The transversal slots 7 are mutually spaced apart at a distance of roughly $\lambda_g$, where $\lambda_g$ represents a wavelength of an electromagnetic wave in the waveguide 2. Two of the longitudinal slots 6 are located between two neighbouring transversal slots 7. All of these slots are spaced apart at an approximate distance of $\lambda_g/2$, as shown in the Figure. The partition wall 4 is provided with longitudinally extending slots 8 which correspond to the longitudinally extending slots 6 in the upper wall 5. In the case of the illustrated embodiment, the slots 6 and the slots 8 are placed in pairs immediately opposite one another. The partition wall 4 has no transversely extending slots. Posts 9 are placed in the lower waveguide 3 on one side of the slots 8, as described hereinafter in more detail with reference to FIG. 3. Placed on the upper wall 5 are longitudinally extending upstanding baffles 10 which are spaced at a distance C from the edges of the waveguide 2. Each of the two waveguides 2 and 3 is supplied with wave energy in a known manner, through the rectangular waveguide connected to one end of the waveguide antenna 1. The energy-supplying waveguides are not shown in FIG. 1, but are merely indicated by broken lines 11. The length of the waveguide antenna 1 will normally be greater than that shown in the Figure and the antenna is terminated at its distance end with a short circuit (not shown), in a conventional manner. The waveguides 2 and 3 have a width A in the order approximately of $\lambda_g/2$ corresponding to a measurement of 0.7 $\lambda_0$, where $\lambda_0$ is the free wavelength of the electromagnetic field. Each of the waveguides 2 and 3 has a vertical extension B, normally an extension B=A/2. This fulfills a condition for single-mode propagation in the waveguides.

Figure 2A:
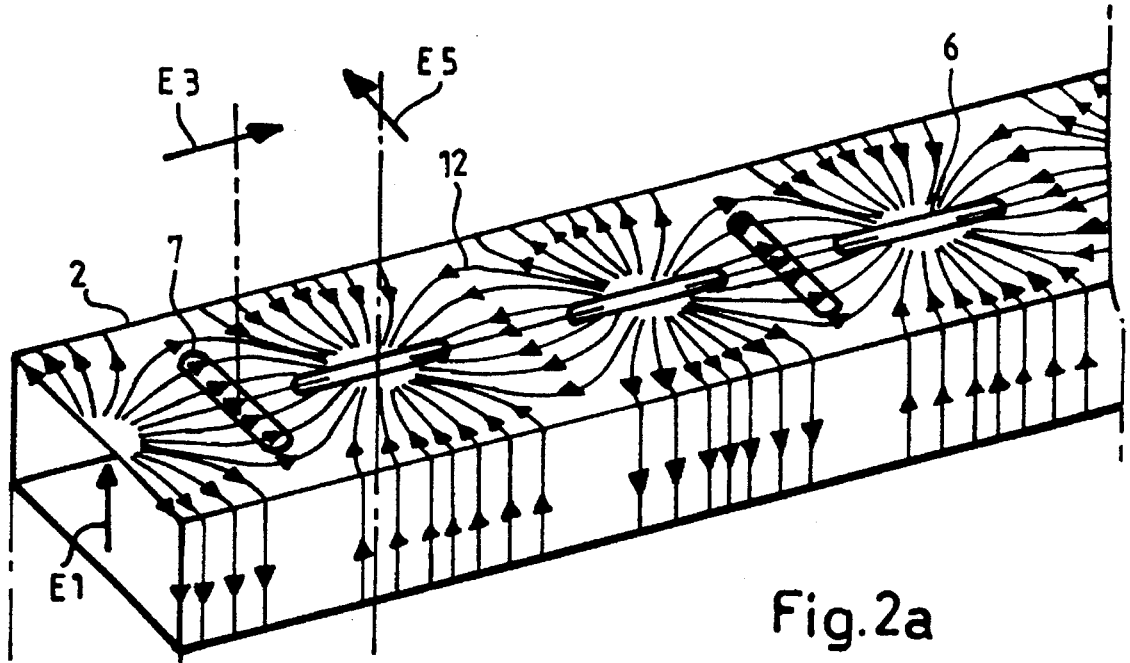
FIG. 2*a* is a perspective view of electric current paths in the upper waveguide.
Figure 2B:
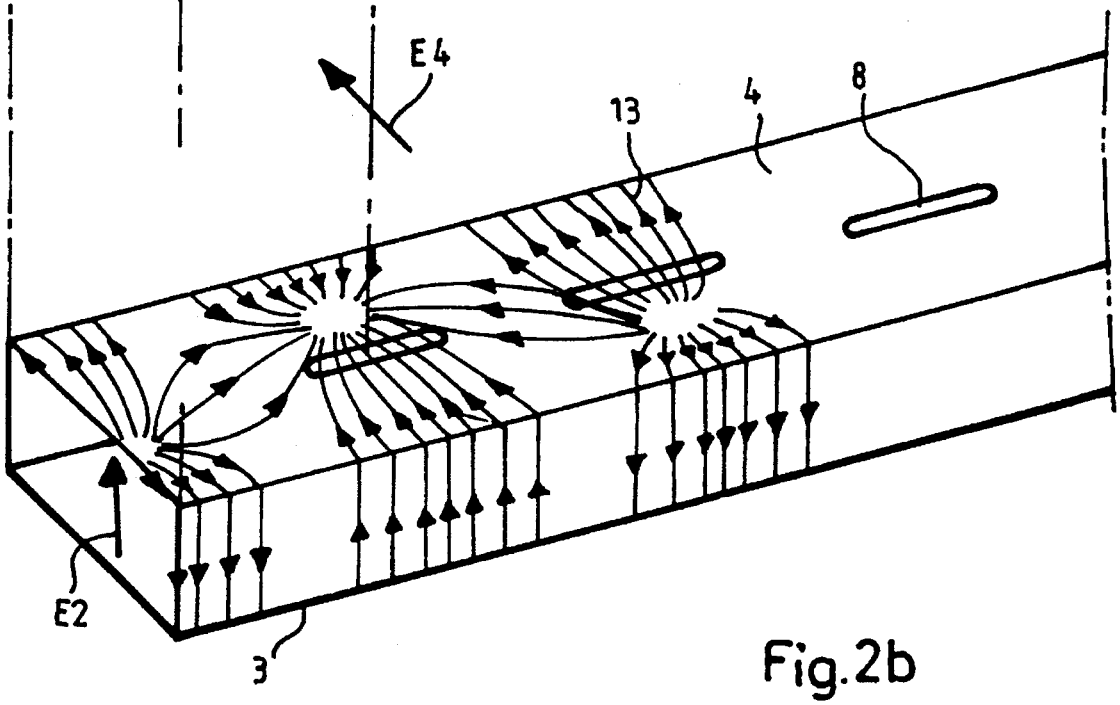
FIG. 2*b* is a perspective view of electric current paths in the lower waveguide.

FIG. 2*a* illustrates current paths 12 for electric surface currents in the upper waveguide 2, and FIG. 2*b* illustrates corresponding current paths in the lower waveguide 3. The current paths in the lower waveguide 3 are displaced, or offset, with the aid of the posts 9, as described in more detail herebelow. The surface currents are generated by a fundamental mode TE10 for electromagnetic fields E1 and E2, which propagate in respective waveguides. Also shown in the Figures is a respective electric field-line for the fundamental mode TE10 of the electric fields E1 and E2. For the sake of clarity, the waveguides of FIGS. 2*a* and 2*b* are shown separate from one another and immediately above each other. The longitudinal slots 6 and the transversal slots 7 in the upper waveguide are also shown in the Figure, together with the longitudinal slots 8 in the partition wall 4.

As will be seen from FIG. 2*a*, the electric current paths 12 are intersected by the transversal slots 7. The slots 7 are excited by the fundamental mode TE10 of the field E1, such that an electromagnetic field E3 is generated in the space above the upper waveguide 2. The direction of polarization of the field E3 lies in the direction of the longitudinal axis of the waveguide 2. The longitudinal slots 6 do not intersect the electric current paths 12 and are not excited by the field E1. The longitudinal slots 6 are not excited by the fundamental mode TE10 in the waveguide 2.

FIG. 2*b* shows that the longitudinal slots 8 in the partition wall 4 intersect the electric current paths 13. The slots 8 are excited by the fundamental mode TE10 of the field E2, such as to generate an electromagnetic field E4 above the partition wall 4.

For the sake of clarity, a field-line of this long field is shown in the Figure to be located at a distance from the partition wall 4, although in reality this field-line propagate upwards in the upper waveguide 2 of FIG. 2*a*, from the slots 8 to the slots 6. This wave propagation is generally similar to the propagation between parallel ground planes. In the present case, these ground planes are comprised of the side walls of the upper waveguide 2 which has the aforesaid vertical extension, or height B. The field E4 is orthogonal to the field E1 in the upper waveguide, and the two fields are mutually independent. The field E4 does not excite a propagating waveguide mode in the upper waveguide 2. On the other hand, the longitudinally extending slots 6 are excited by the field E4, such as to generate an electromagnetic field E5 above the upper waveguide 2. The direction of polarization of the field E5 lies in the transverse direction of the upper waveguide 2.

The two fields E3 and E5 in the space above the waveguide 2 are superimposed to form a common field. As before mentioned, the two fields E1 and E4 in the waveguide 2 are orthogonal and can be selected fully independently of one another which means that the fields E3 and E5 are also independent of one another. The independent fields in the waveguide 2 are obtained by supplying the waveguides 2 and 3 with the fields E1 and E2 respectively, independently of one another. The common electric field above the waveguide 2 can be given a desired polarization, by appropriate selection of field amplitude and field phase. Because the fields E3 and E5 are independent of one another, they are able to carry information of different content.

The electric field E5 propagates in a lobe which is symmetrical about a geometric normal to the upper surface 5, since the longitudinally extending slots 6 are placed at a resonant distance from one another. This lobe lacks disturbing high-order lobes, so-called grating lobes, because the distance $\lambda_g/2$ between the longitudinal slots 6 is smaller than the free wavelength $\lambda_0$. The field E3 propagates correspondingly in a lobe which is symmetrical about the geometric normal of the antenna, but has grating lobes since the transversal slots 7 are placed at a distance $\lambda_g$ which is greater than $\lambda_0$. The grating lobes are counteracted by the baffles 10, which have the form of upstanding, electrically conductive walls disposed on both sides of the slots 6 and 7. The baffles are placed on the upper surface 5 of the waveguide 2, at a distance C from the edge line of the upper surface. A more detailed description of such baffles is given in Swedish Patent Application No. 9000959-8. The total electric field from the waveguide antenna 1 propagates in a lobe which is symmetrical about the geometric normal of the antenna and essentially lacks side-lobes. The direction of the lobe is frequency-dependent.

It will be seen from FIG. 2*a* that the transversal slots 7 intersect the electric current paths 12, even though the slots are displaced slightly in the direction of the longitudinal axis of the waveguide 2. Relative displacement of the slots can therefore be permitted without impairing antenna performance. It is important, however, that the slots, on average, are spaced apart by the aforesaid resonant distance $\lambda_g$. Correspondingly, it is possible to displace the slots 8 in the partition wall 4 slightly in relation to one another. In this case, the longitudinal slots 6 are displaced to a corresponding extent, without intersecting any of the current paths 12.

Figure 3:
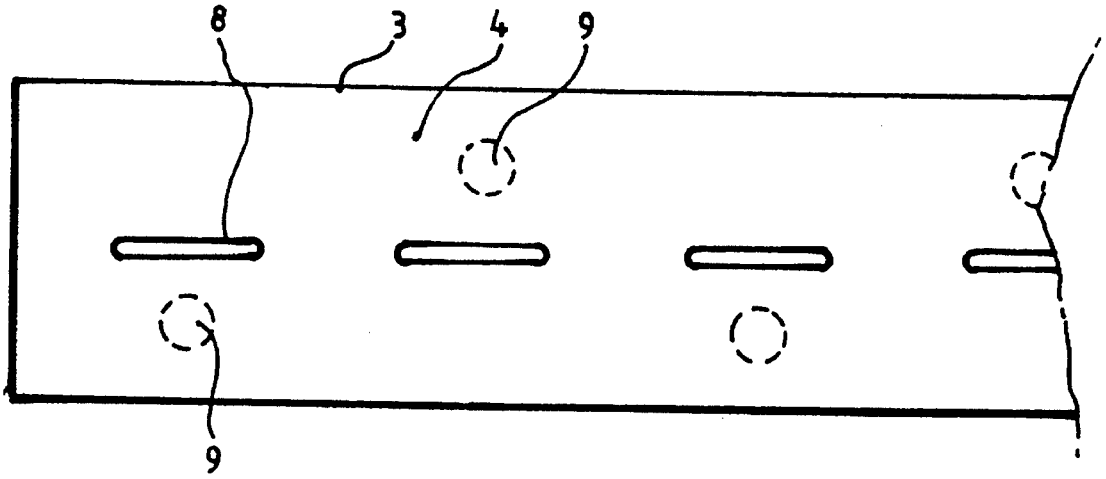
FIG. 3 illustrates the lower waveguide from above.

Positioning of the posts 9 is shown in more detail in FIG. 3. The Figure is a view taken from above the lower waveguide 3 and shows the partition wall 4 and the longitudinally extending, elongated slots 8. A post 9 is placed on one side of each slot 8, alternately on one and the other side of the waveguide centre line, so as to form a zig-zag pattern. The posts in the illustrated of FIG. 1 are hidden by the partition wall and shown are in broken lines. These posts are cylinders which extend from the bottom wall of the waveguide up towards the partition wall but terminate short of said wall. The displacement of the electric current paths 13 shown in FIG. 2*b* is achieved because of the zig-zag positioning of the posts 9 (not shown). This displacement of the electric current paths causes the field E4 to be radiated outwards in the manner desired, with all slots 8 in phase with one another.

Figure 4:
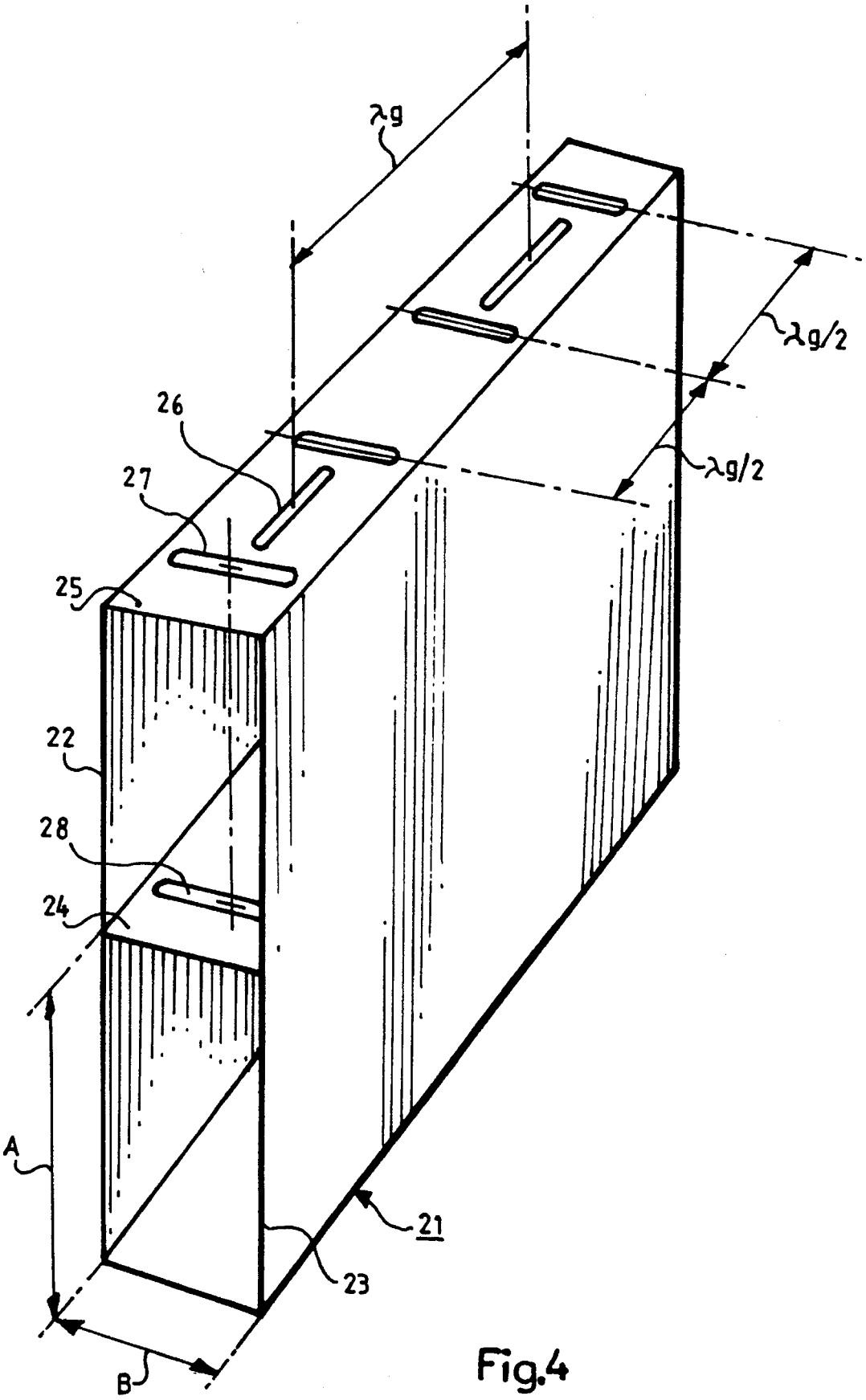
FIG. 4 is a perspective view of an alternative embodiment of the invention.

FIG. 4 illustrates an alternative embodiment of the inventive waveguide antenna, here referenced 21. This antenna is comprised of an upper rectangular cavity waveguide 22 and a lower rectangular cavity waveguide 23. The waveguides are placed edgewise, one on the other, with the narrow long sides of the waveguides extending along one another and being separated by a partition wall 24. The upper wall 25 of the upper waveguide 22 is provided with elongated slots 26, which are spaced apart at a distance $\lambda_g$ and which extend in the direction of the longitudinal axis of the waveguide. Located between two neighbouring longitudinal slots 26 are two transversal slots 27, these slots being spaced apart at a mutual distance of $\lambda_g/2$. All of the slots are placed generally symmetrically along a centre line of the upper wall 25. The partition wall 24 is provided with elongated, transversely extending slots 28 which are located immediately beneath the transverse slots 27 in the upper wall 25. The waveguides 22 and 23 have mutually the same cross-section measurements A and B as the waveguides 2 and 3 of the waveguide antenna illustrated in FIG. 1.

Figure 5:
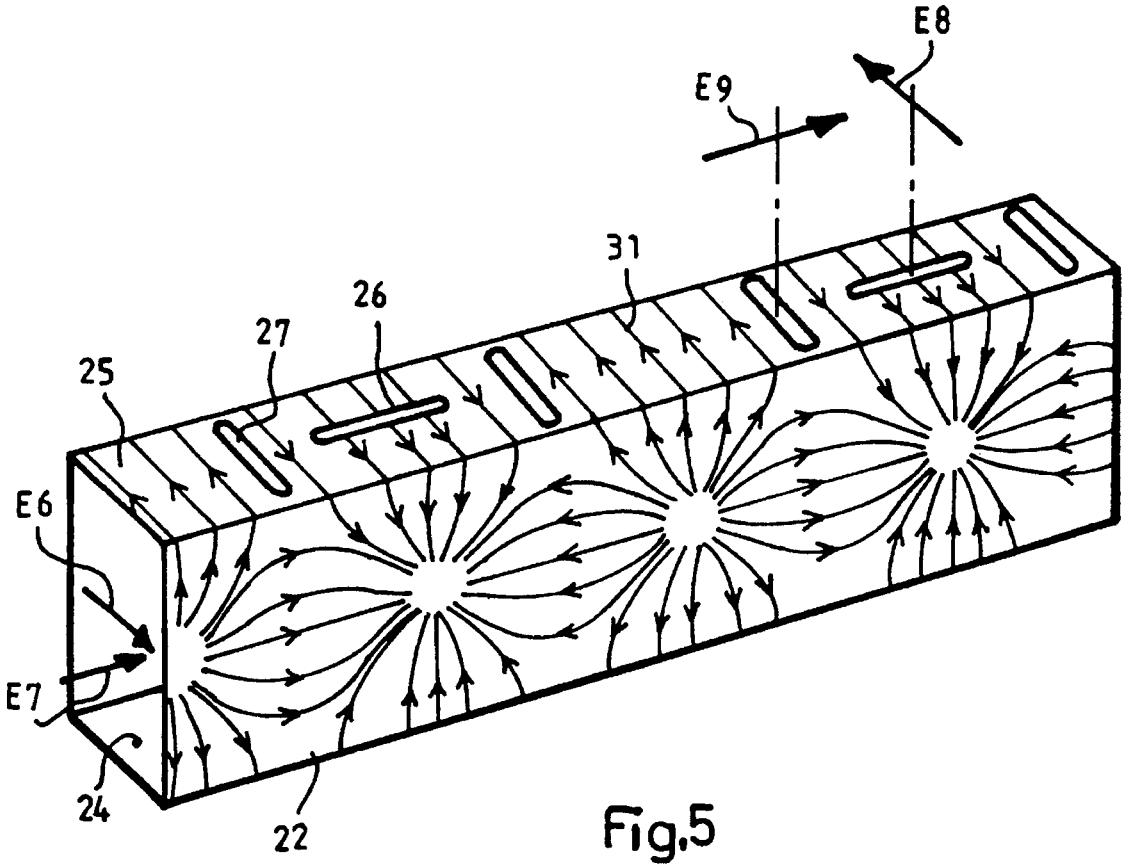
FIG. 5 is a perspective view of electric current paths in the upper waveguide of the alternative embodiment.

Current paths 31 for surface currents in the upper waveguide 22 are shown in FIG. 5. The surface currents are generated by the fundamental mode TE10 of an electromagnetic field E6 which propagates in the waveguide 22. One electric field-line of this field is shown in the Figure. The current paths 31 are intersected by the longitudinally extending slots 26, which are excited by the field E6 and radiate a field E8 which is polarized in the cross-direction of the waveguide.

The lower waveguide 23 is supplied with the fundamental mode TE10 of an electromagnetic field which produces surface currents in said waveguide. Current paths for these surface currents, which are not shown in any Figure, are displaced, in a known manner, by means of the posts or by means of diaphragms, so that the current paths are intersected by the transversal slots 28 in the partition wall. These slots are exited and radiate outwards a field E7 which, in turn, excites the slots 27. A field E9 propagates from the transversal slots 27 in the space above the wall 25. This field has its direction of polarization in the direction of the longitudinal axis of the waveguide 22 and coacts with the field E8 to form a common field.

Each of the two waveguides 22 and 23 is supplied with its respective electromagnetic field independently of the other. The fields E6 and E7 in the waveguide 22 are orthogonal and do not influence one another, so that phase and amplitude of the radiated fields E8 and E9 can be selected without restriction. This enables the polarization of the common field to be selected without restriction. The slots 26 and 27 all lie at a resonant distance from one another, so that the radiation lobe of the common field is symmetrical about the geometric normal to the upper wall.

In the case of the illustrated exemplifying embodiments of the invention, the cavity waveguides 2, 3, 22 and 23 are single, rectangular waveguides. In the case of further embodiments of the invention, the waveguides are ridge waveguides or waveguides that are provided internally with a dielectric. In the described embodiments, the lower waveguide is provided with posts 9 or diaphragms for displacing the surface currents in the manner desired. However, it is conceivable to construct the waveguides in a manner which will render the posts superfluous, for instance by displacing the waveguides laterally in relation to one another. The upper and the lower waveguide of the exemplified waveguide antennas have mutually the same width A and vertical extension B. It will be understood, however, that it lies within the purview of the invention for both of the waveguides of an antenna to have different cross-sectional measurements. In the case of the illustrated embodiments, the slots are placed along the centre line of the waveguides, where the magnetic component of the electromagnetic field has its zero crossing. It is possible to produce waveguides in which this zero crossing is displaced laterally. In these cases, the term "centre line" is meant to imply an electromagnetic symmetry line. In the example illustrated in FIG. 1, the waveguides are terminated with a short circuit. It will be understood, however, that the waveguides may be terminated reflection-free with a matched load.

Figure 6:
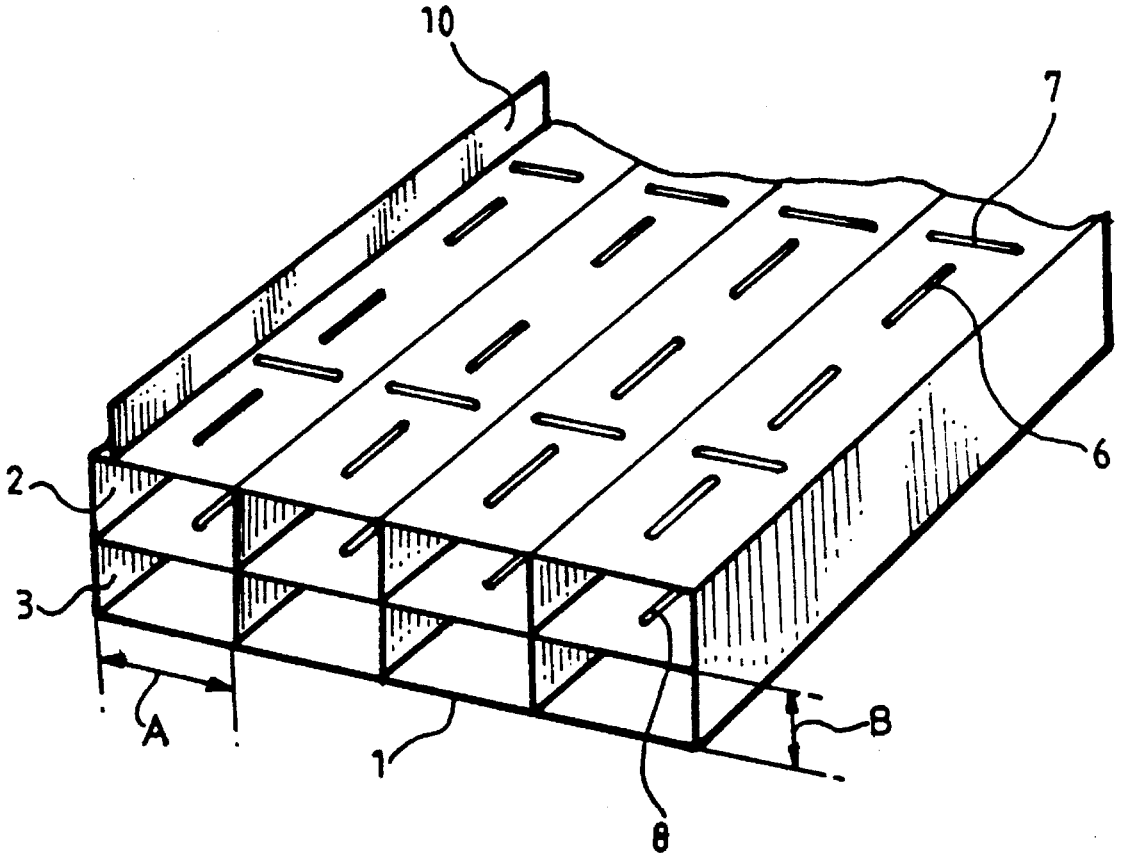
FIG. 6 is a perspective view of an antenna comprised of several waveguide pairs.

An antenna comprised of inventive waveguide antennas 1 is illustrated in FIG. 6. For the sake of clarity, only one of the baffles 10 has been shown. As explained in the aforegoing, the upper and the lower waveguides 2 and 3 respectively may be supplied with energy independently of one another, so that a Common electromagnetic field which propagates above the antenna will have a desired polarization. The waveguides may be given a width A which is so small that the fields emanating from the individual waveguide antennas 1 can be caused to coact with one another without generating grating lobes. The lobe of the common field can be directed laterally, by phase-shifting the supply of energy to the individual waveguide antennas 1.

The inventive antenna affords several advantages over those antennas known hitherto. The two antenna ports can be supplied with energy independently of each other and a field of desired polarization can be generated. The radiation lobe generated is symmetrical, particularly in the transverse direction of the waveguides. The two fields of mutually separate polarizations have common apertures, and grating lobes can be suppressed with the aid of simple means. The antenna is of simple construction and can be readily supplied with wave energy.

I claim:

1. A waveguide antenna, comprising:

a first waveguide including a first wall having a set of longitudinal slots which are spaced apart at a maximum distance of approximately $\lambda_g$,where $\lambda_g$ is the wavelength in the waveguide, and a set of transverse sloes which are spaced apart at a maximum distance $\lambda_g$, the longitudinal and transverse slots being substantially disposed about the electromagnetic symmetry line of the first waveguide in only one row, and the longitudinal slots and traverse slots being disposed substantially perpendicular to each other;

a second waveguide, disposed beneath said first waveguide, with a longitudinally extending center line of the first waveguide being disposed parallel to a longitudinally extending center line of the second waveguide;

a partition wall, disposed between said first and second waveguides and opposite to said first wall, having a set of one type of slots corresponding to one of the sets of the longitudinal and transverse slots in said first wall of said first waveguide;

wherein said first and said second waveguides are independently fed electromagnetic energy having different polarizations.

2. A waveguide antenna according to claim 9 wherein each of the first and second waveguides includes an input for the supply of electromagnetic energy.

3. A waveguide antenna according to claim 1 wherein said first and second waveguides are substantially rectangular with pairs of short and long sides, the partition wall is disposed along the adjacent long sides of said first and second substantially rectangular waveguides and includes longitudinal slots, and the first wall of the first waveguide has two longitudinal slots disposed between two transverse slots, wherein the longitudinal slots are spaced apart at a distance of approximately $\lambda_g/2$.

4. A waveguide antenna according to claim 2 wherein said first and second waveguides are substantially rectangular with pairs of short and long sides, the partition wall is disposed along the adjacent long sides of said first and second substantially rectangular waveguides and includes longitudinal slots, and the first wall of the first waveguide has two longitudinal slots disposed between two transverse slots, wherein the longitudinal slots are spaced apart at a distance of approximately $\lambda_g/2$.

5. A waveguide antenna according to claim 1 wherein said first and second waveguides are substantially rectangular with pairs of short and long sides, the partition wall is disposed along the adjacent short sides of said first and second substantially rectangular waveguides and includes longitudinal slots, and the first wall of the first waveguide has two longitudinal slots disposed between two transverse slots, wherein the longitudinal slots are spaced apart at a distance of approximately $\lambda_g/2$.

6. A waveguide antenna according to claim 2 wherein said first and second waveguides are substantially rectangular with pairs of short and long sides, the partition wall is disposed along the adjacent short sides of said first and second substantially rectangular waveguides and includes longitudinal slots, and the first wall of the first waveguide has two longitudinal slots disposed between two transverse slots, wherein the longitudinal slots are spaced apart at a distance of approximately $\lambda_g/2$.

7. A waveguide antenna according to claim 3 which further includes field shifting projections disposed in the second waveguide on different sides of the longitudinal slots, wherein each alternate longitudinal slot has the projections on the same side.

8. A waveguide antenna according to claim 4 which further includes field shifting projections disposed in the second waveguide on different sides of the longitudinal slots, wherein each alternate longitudinal slot has the projections on the same side.

9. An antenna waveguide according to claim 1 wherein the first wall of the first waveguide is provided with upstanding, electrically conductive baffles which extend along both sides of the first waveguide.

10. A waveguide antenna according to claim 1 wherein the first and second waveguides have a reflection-free termination.

11. A waveguide antenna according to claim 1 wherein the first and second waveguides have a short circuited termination.

12. An antenna waveguide according to claim 2 wherein the first wall of the first waveguide is provided with upstanding, electrically conductive baffles which extend along both sides of the first waveguide.

13. A waveguide antenna according to claim 2 wherein the first and second waveguides have a reflection-free termination.

14. A waveguide antenna according to claim 2 wherein the first and second waveguides have a short circuited termination.

15. An antenna waveguide according to claim 4 wherein the first wall of the first waveguide is provided with upstanding, electrically conductive baffles which extend along both sides of the first waveguide.

16. A waveguide antenna according to claim 4 wherein the first and second waveguides have a reflection-free termination.

17. A waveguide antenna according to claim 4 wherein the first and second waveguides have a short circuited termination.

18. An antenna waveguide according to claim 5 wherein the first wall of the first waveguide is provided with upstanding, electrically conductive baffles which extend along both sides of the first waveguide.

19. A waveguide antenna according to claim 5 wherein the first and second waveguides have a reflection-free termination.

20. A waveguide antenna according to claim 5 wherein the first and second waveguides have a short circuited termination.

21. An antenna waveguide according to claim 6 wherein the first wall of the first waveguide is provided with upstanding, electrically conductive baffles which extend along both sides of the first waveguide.

22. A waveguide antenna according to claim 6 wherein the first and second waveguides have a reflection-free termination.

23. A waveguide antenna according to claim 6 wherein the first and second waveguides have a short circuited termination.

24. An antenna waveguide according to claim 7 wherein the first wall of the first waveguide is provided with upstanding, electrically conductive baffles which extend along both sides of the first waveguide.

25. A waveguide antenna according to claim 7 wherein the first and second waveguides have a reflection-free termination.

26. A waveguide antenna according to claim 7 wherein the first and second waveguides have a short circuited termination.

27. An antenna waveguide according to claim 8 wherein the first wall of the first waveguide is provided with upstanding, electrically conductive baffles which extend along both sides of the first waveguide.

28. A waveguide antenna according to claim 8 wherein the first and second waveguides have a reflection-free termination.

29. A waveguide antenna according to claim 8 wherein the first and second waveguides have a short circuited termination.

30. A waveguide antenna according to claim 1 wherein at least the first waveguide is a single mode waveguide.

31. A waveguide antenna according to claim 1 wherein the slots in the partition wall are identical to the set of one type of slots in the first waveguide and the identical set of slots in the partition wall are aligned along the same axis as the identical slots of the first waveguide.

* * * * *